US006042494A

United States Patent [19]

Rappaport et al.

[11] Patent Number: 6,042,494

[45] Date of Patent: Mar. 28, 2000

[54] THROWING TOY WITH RETRACTABLE TAIL

[76] Inventors: Mark J. Rappaport, 4912 Linea Del Ceilo, Rancho Santa Fe, Calif. 92067; Jose E. Leal, 5 Durant Ave., Maynard, Mass. 01754

[21] Appl. No.: 09/096,159

[22] Filed: Jun. 11, 1998

Related U.S. Application Data

[63] Continuation-in-part of application No. 08/926,951, Sep. 10, 1997.

[51] Int. Cl.[7] ..... A63B 43/00

[52] U.S. Cl. ..... 473/613

[58] Field of Search ..... 473/575, 576, 473/580, 584, 585, 586, 587, 596, 613; 446/66

[56] References Cited

U.S. PATENT DOCUMENTS

| | | | |
|---|---|---|---|
| 23,538 | 4/1859 | Arnold . | |
| D. 288,216 | 2/1987 | Jensen . | |
| D. 306,894 | 3/1990 | DeMarco . | |
| D. 346,001 | 4/1994 | Stillinger et al. . | |
| D. 348,907 | 7/1994 | Prentice et al. . | |
| D. 350,577 | 9/1994 | Giudice . | |
| D. 355,460 | 2/1995 | Routzong et al. . | |
| D. 361,811 | 8/1995 | Grimm et al. . | |
| 1,293,869 | 2/1919 | Murray et al. . | |
| 1,296,403 | 3/1919 | Kindle . | |
| 1,520,131 | 12/1924 | Jacob . | |
| 1,651,499 | 12/1927 | Woodrow | 473/581 |
| 1,718,508 | 6/1929 | White . | |
| 2,183,152 | 12/1939 | Prensky et al. . | |
| 2,338,719 | 1/1944 | Holt . | |
| 2,432,209 | 12/1947 | Osgood . | |
| 2,494,026 | 1/1950 | Anderson . | |
| 2,608,027 | 8/1952 | Perker et al. . | |

(List continued on next page.)

FOREIGN PATENT DOCUMENTS

| | | |
|---|---|---|
| 900310 | 12/1953 | Germany . |
| 469863 | 9/1937 | United Kingdom . |

OTHER PUBLICATIONS

Barr Rubber Products Co., 1965 Athletic Ball Catalog (1 page).

*Primary Examiner*—Steven Wong
*Attorney, Agent, or Firm*—Kolisch, Hartwell, Dickinson, McCormack & Heuser

[57] ABSTRACT

A throwing toy is provided that is configured to be held in a user's hand and thrown by the user with the user's hand imparting to the toy during release a spin about the toy's axis. The toy has a head portion and a tail portion adjacent the rear end of the head portion. The tail is configured to be selectively changeable by the user between an extended position wherein at least a part of the tail extends rearward of the head portion along the axis for a tail length and a retracted position wherein the tail length is reduced. The toy has a coupling connected to the head portion which includes a tail control mechanism supporting the tail portion. The control mechanism is configured to allow the user to change the tail between the extended and the retracted positions. The tail control mechanism includes a cylinder installed in the head portion and a piston movable in the cylinder. The tail portion is coupled to the piston and a biasing means urges the tail portion toward one of the extended or retracted positions. A latching mechanism is selectively operable by the user to fix the tail in one of the positions and operable by a user to unlatch the tail from the fixed position. The latching mechanism includes a latch coupled to the tail portion and a clasp coupled to the head portion, wherein the clasp is selectively operable by the user to hold the latch. The latching mechanism further includes a switch disposed within the head portion below an outer surface of the head portion, and the switch is operable by the user by depressing the outer surface of the head portion to release the clasp's hold on the latch.

16 Claims, 4 Drawing Sheets

U.S. PATENT DOCUMENTS

| | | | |
|---|---|---|---|
| 2,611,999 | 9/1952 | Mikolay . | |
| 2,759,297 | 8/1956 | Lewis . | |
| 2,763,958 | 9/1956 | Lemelson . | |
| 2,870,570 | 1/1959 | Benson . | |
| 3,147,011 | 9/1964 | Lemelson . | |
| 3,190,654 | 6/1965 | Ross . | |
| 3,198,526 | 8/1965 | Smith et al. . | |
| 3,225,488 | 12/1965 | Goldfarb . | |
| 3,256,020 | 6/1966 | Smith . | |
| 3,292,879 | 12/1966 | Chilowsky . | |
| 3,437,340 | 4/1969 | Grise . | |
| 3,528,662 | 9/1970 | Merchant et al. . | |
| 3,746,334 | 7/1973 | Stubblefield . | |
| 3,909,976 | 10/1975 | Kirk . | |
| 4,019,738 | 4/1977 | Tong . | |
| 4,021,041 | 5/1977 | Goldfarb et al. . | |
| 4,088,319 | 5/1978 | Clarke . | |
| 4,106,770 | 8/1978 | Gray | 473/581 |
| 4,112,613 | 9/1978 | Toplak . | |
| 4,294,447 | 10/1981 | Clark . | |
| 4,332,383 | 6/1982 | Milden et al. | 473/127 |
| 4,335,537 | 6/1982 | Walker . | |
| 4,339,138 | 7/1982 | Di Manno . | |
| 4,366,936 | 1/1983 | Ferguson . | |
| 4,531,737 | 7/1985 | Jacobson et al. . | |
| 4,537,405 | 8/1985 | Cymbler . | |
| 4,657,253 | 4/1987 | Lerner et al. . | |
| 4,736,948 | 4/1988 | Thomas . | |
| 4,842,285 | 6/1989 | Farler . | |
| 4,900,037 | 2/1990 | Miller | 473/586 |
| 4,930,777 | 6/1990 | Holenstein . | |
| 4,943,066 | 7/1990 | Lathim et al. . | |
| 4,946,172 | 8/1990 | Wong . | |
| 4,958,838 | 9/1990 | Farler . | |
| 4,978,130 | 12/1990 | Farler . | |
| 5,066,017 | 11/1991 | Kurland . | |
| 5,112,062 | 5/1992 | Pratt . | |
| 5,228,690 | 7/1993 | Rudell et al. . | |
| 5,267,735 | 12/1993 | Bushman . | |
| 5,269,514 | 12/1993 | Adler et al. . | |
| 5,269,535 | 12/1993 | Gagne | 473/585 |
| 5,284,341 | 2/1994 | Routzong et al. . | |
| 5,642,887 | 7/1997 | Orav | 473/586 |
| 5,779,576 | 7/1998 | Smith, III et al. . | |
| 5,807,198 | 9/1998 | Grimm . | |
| 5,836,842 | 11/1998 | McLearan | 473/581 |

THROWING TOY WITH RETRACTABLE TAIL

This application is a continuation-in-part of U.S. patent application Ser. No. 08/926,951, filed on Sep. 10, 1997 for a Throwing Toy with Non-Spinning Tail, which is hereby incorporated by reference.

BACKGROUND OF THE INVENTION

The present invention relates generally to toy throwing balls. More particularly, it is directed to a toy throwing ball with a main ball-shaped body and a finned tail mounted on a shaft that can be retracted into the body or extended behind the body.

Throughout the prior art, fins have been used on various kinds of flying toys to increase flight stability, accuracy, and distance. These fins typically extend outwardly from the toy, spaced-apart around a longitudinal axis. Often the fins are mounted on a tail extending rearwardly from the toy. The addition of the tail moves both the center of pressure and the center of gravity of the combined football-and-tail rearward as compared to the football alone. However, the greater surface area-to-weight ratio of the finned tail, as compared to the football, moves the center of pressure farther rearward, ideally to a position aft of the center of gravity which provides inherent stability. The addition of the finned tail is believed to increase the flight distance of the toy, but it also adds to the overall length of the toy which can be inconvenient when carrying the toy, either in a bag between games or in a hand during play.

SUMMARY OF THE INVENTION

The present invention is a throwing toy, including a head portion having a front end and a rear and, a tail portion adjacent the rear end, and a coupling connected to the head portion and supporting the tail portion. The coupling includes a tail control mechanism configured to allow a user selectively to change the tail portion between an extended position and a retracted position, the tail in the extended position extending relatively farther aft of the rear end as compared to the retracted position. The user may select the retracted position for compact storage of the toy or for desired game characteristics and the extended position for throwing the football. The extended position is believed to provide the toy with improved stability for longer, more accurate flight characteristics.

DETAILED DESCRIPTION OF THE PREFERRED EMBODIMENT

Figure 1:
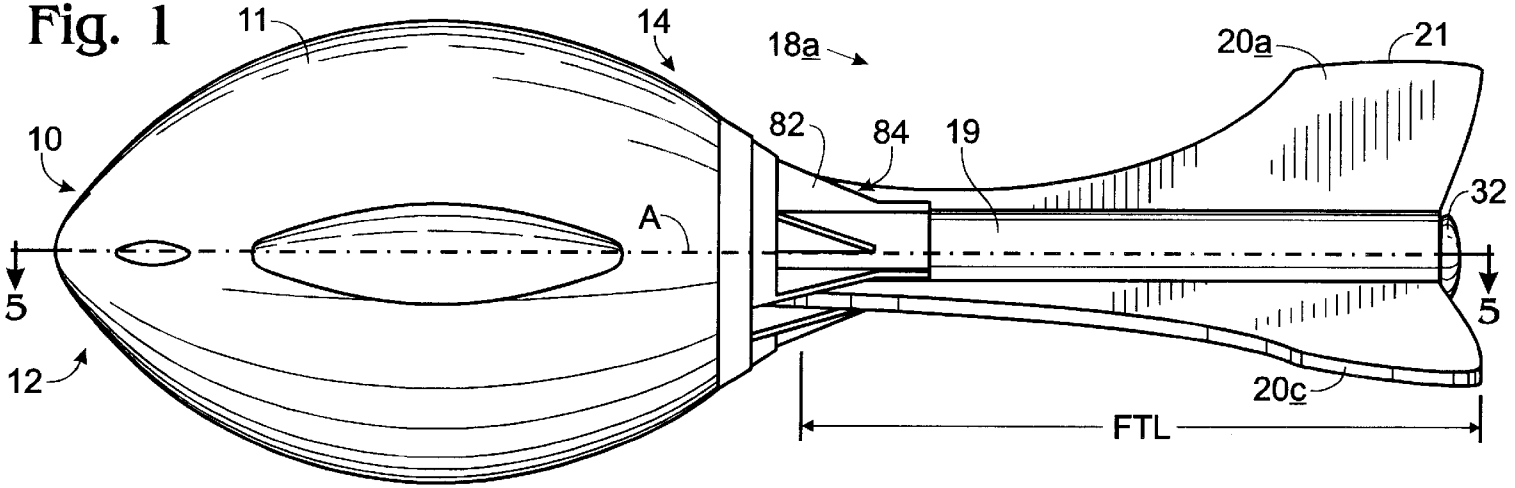
FIG. 1 is a side elevation of a throwing toy constructed according to the invention showing a football-shaped head portion and a finned tail portion in an extended position.
Figure 2:
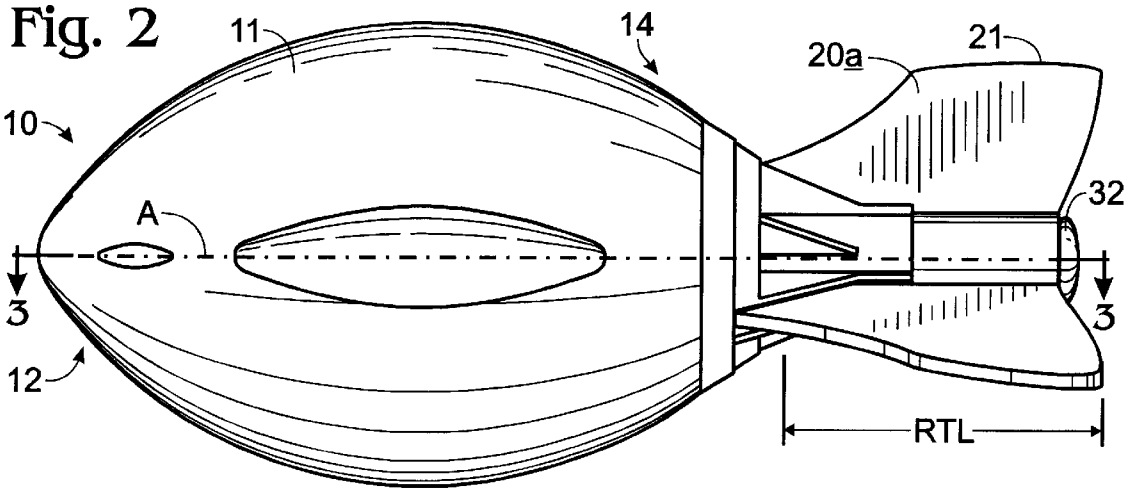
FIG. 2 is a side elevation view of the toy of FIG. 1 with the tail portion in a retracted position.

An embodiment of the present invention is shown generally at 10 in FIGS. 1 and 2. The invention is a throwing toy adapted to be held in a user's hand and thrown by the user for a flight through the air, the flight beginning as the toy is accelerated in, and released from, the user's hand and ending when the toy either is caught by another user or strikes the ground. The user can selectively switch the toy while holding it between a full-length condition as shown in FIG. 1 and a reduced-length condition as shown in FIG. 2. Referring to FIG. 1, in the disclosed embodiment, the throwing toy includes a head portion, such as football-shaped ball 11. In the disclosed embodiment, head portion 11 has a tapered front end, indicated generally at 12, and a tapered rear end, indicated generally at 14. However, in alternative embodiments, the head portion may be any other type of ball or throwing device, including an elongate ball with one tapered end and one semi-spherical end.

Front end 12, rear end 14, and head portion 11 are generally centered about a longitudinal axis A, represented by the dash-dot line shown in FIGS. 1 & 2. Head portion 11 has a shape that is generally symmetric about axis A and is preferably constructed to be sufficiently rigid to maintain substantially its shape throughout each flight of the toy. Ideally, head portion 11 is made at least partially from a foam material preferably polyurethane foam, which is durable and soft enough to be easy to catch and safe even for younger children.

The throwing toy also includes an elongate tail portion, indicated generally at 18*a*, which extends axially rearward from rear end 14 along longitudinal axis A. Tail portion 18*a* includes an elongate, generally cylindrical member 19, preferably made of extruded polyethylene foam, and three fins 20*a*, 20*b* (not shown), and 20*c*, die-cut from a sheet of extruded polyethylene foam and adhesively bonded to member 19. Member 19 extends along, and is generally centered about, axis A and fins 20*a–c* extend radially outward from member 19. The three fins are preferably evenly spaced-apart around longitudinal axis A at angles of approximately 120 degrees. However, in alternative embodiments, there may be a greater or lessor number of fins, spaced-apart around the longitudinal axis at various intervals. Although fins 20*a*, 20*b*, and 20*c*, as best seen in FIG. 2, are roughly triangular fins, but with a flattened outer edge 21, in alternative embodiments they might be curved, right-triangular, square-shaped, half-circle shaped, or any one or more of numerous other designs. Preferably, tail portion 18*a* is constructed to be durable and sufficiently rigid to maintain its shape throughout the flight of the ball, while yet being soft enough to be safe, as with polyethylene foam.

Figure 3:
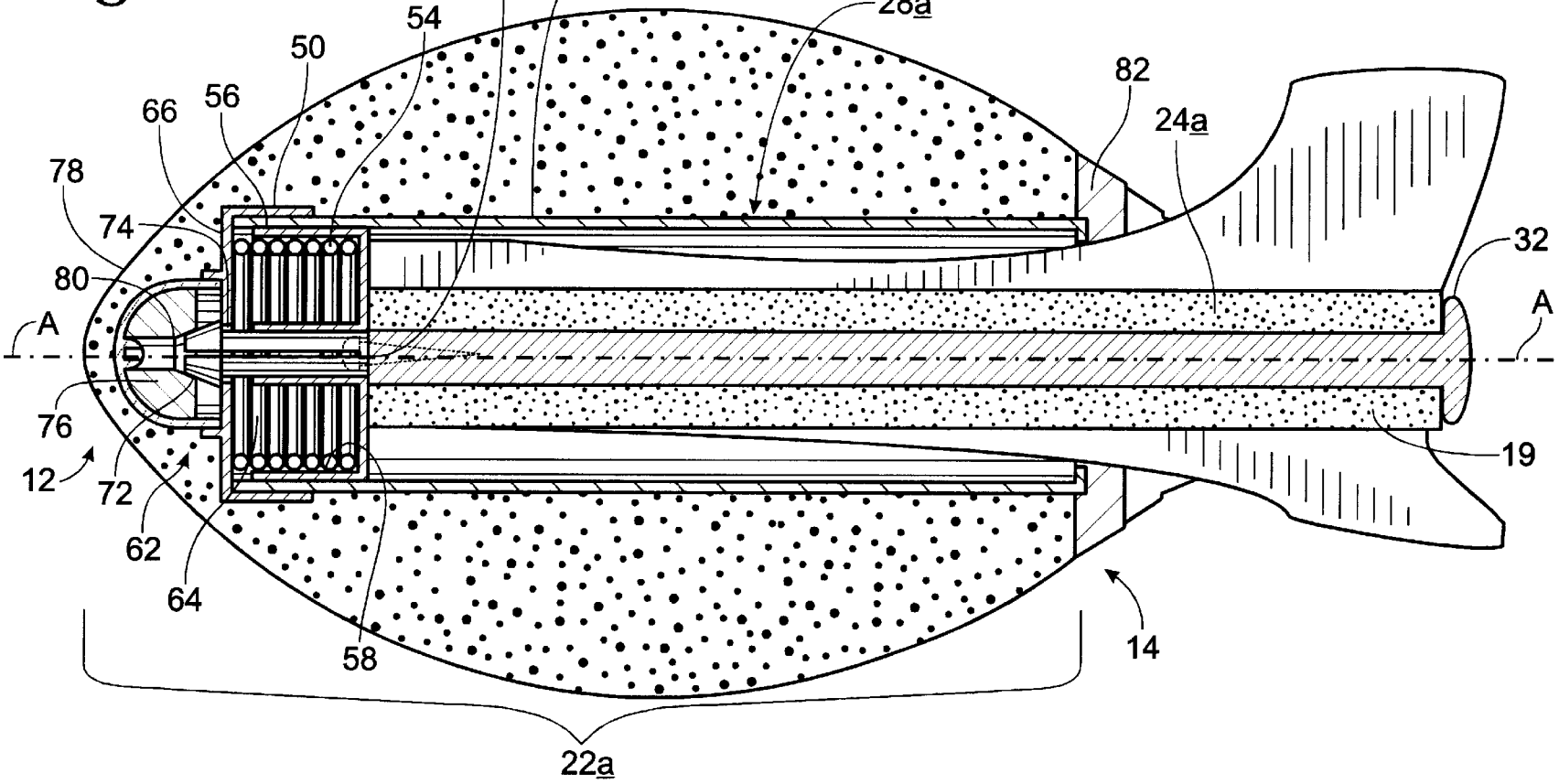
FIG. 3 is a cross-sectional side view of the toy of FIG. 1 showing a switch located in the nose of the ball for controlling a latching mechanism connected to a spring-biased piston which is translationally movable in a cylinder running along the longitudinal axis of the ball, the piston being coupled to a shaft upon which the tail is mounted, the tail being shown in the retracted position with the latching mechanism engaged.

Tail portion 18*a* and head portion 11 are movably coupled together by a coupling, shown generally at 22*a* in the cross-sectional view in FIG. 3, which allows the head and tail portions to be movable relative to each other. Coupling 22*a* is disposed within a cavity 28*a* in head portion 11 and connected therein to the head portion by any suitable means such as adhesive or the resilience of the polyurethane foam of the head portion. Coupling 22*a* includes a tail control mechanism 50 supporting tail portion 18*a*.

Tail control mechanism 50 is configured, as will be described in detail below, to allow the user, while holding the toy in hand, selectively to change the toy between the full-length condition, wherein tail portion 18*a* is in an extended position as shown in FIG. 1 with at least a part of the tail portion extending rearward along axis A for a full tail length FTL, and the reduced-length condition, wherein tail portion 18*a* is in a retracted position as shown in FIG. 2 with a part of the tail retracted into the head portion and a reduced tail length RTL extending from the rear of head portion. It will be understood that the tail portion in the extended or full-length condition may be partly within the head portion or that the tail portion in the retracted or reduced-length condition may not extend from the rear end of the head portion at all and still be within the scope of the invention.

Figure 5:
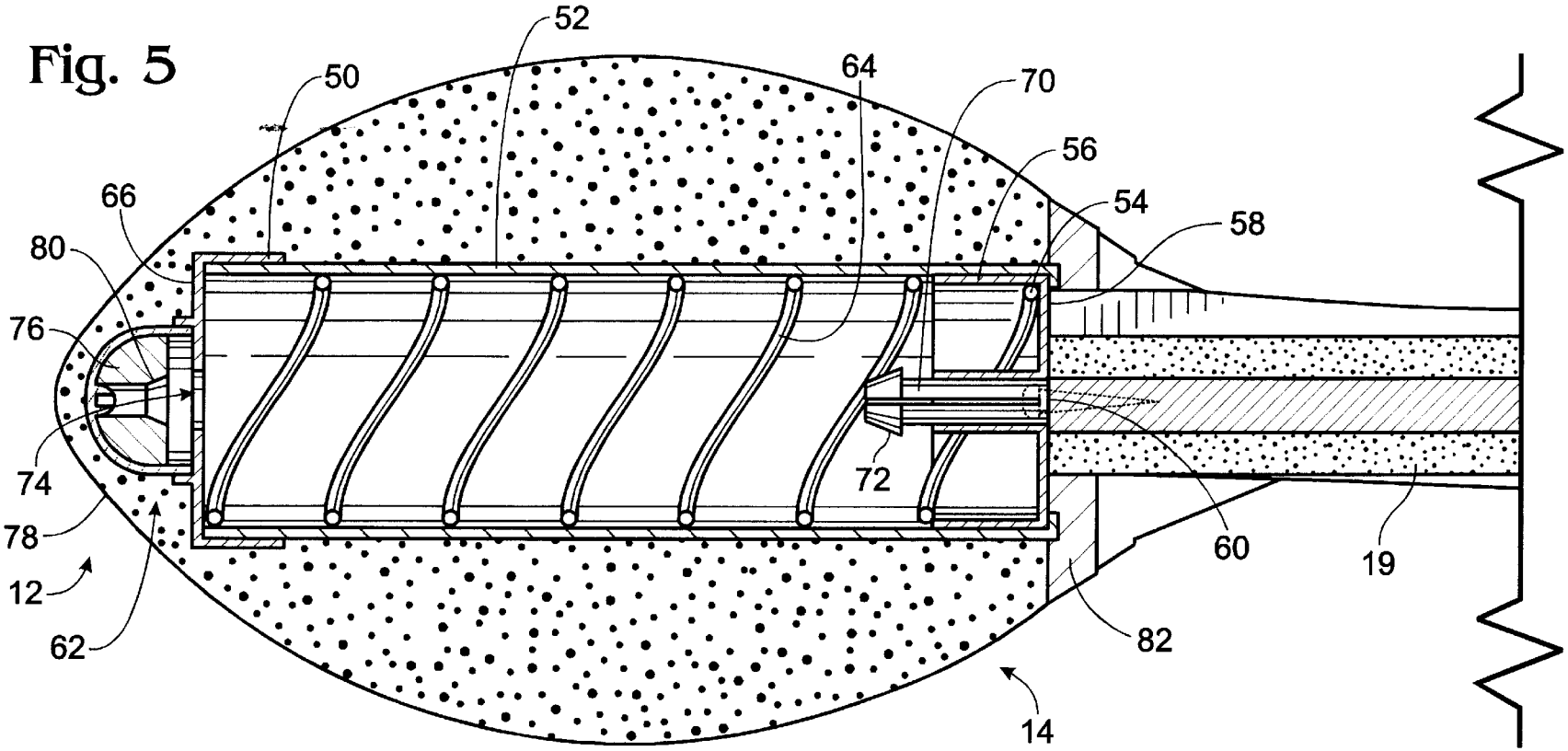
FIG. 5 is a cross-sectional side view of the toy of FIG. 1 showing the tail in the extended position and the spring at full extension.

Coupling 22*a* includes a shaft, such as elongate plastic dowel 24*a,* to which elongate cylindrical member 19 of tail portion 18*a* is attached by insertion thereover. Tail-control mechanism 50 includes a cylinder 52 preferably centered along longitudinal axis A. A piston 54 with cylindrical sidewall 56 and basewall 58 is movable in cylinder 52 along axis A between a first position adjacent front end 12, corresponding to the reduced-length condition and retracted position of tail portion 18*a,* as shown in FIG. 3, and a second position adjacent rear end 14, corresponding to the full-length condition and extended position of tail portion 18*a* as shown in FIG. 5.

Shaft 24*a,* and thus tail portion 18*a,* are coupled to piston 54 by a fastener, such as screw 60. A biasing means, such as spring 64, is disposed in cylinder 52 to urge piston 54, preferably toward the second, rear position but alternatively toward the first, front position. In the preferred embodiment, an end cap 66 is fixed at a front end of cylinder 52 and spring 64 is biased against end cap 64 to urge piston 54 toward rear end 14.

Figure 6:
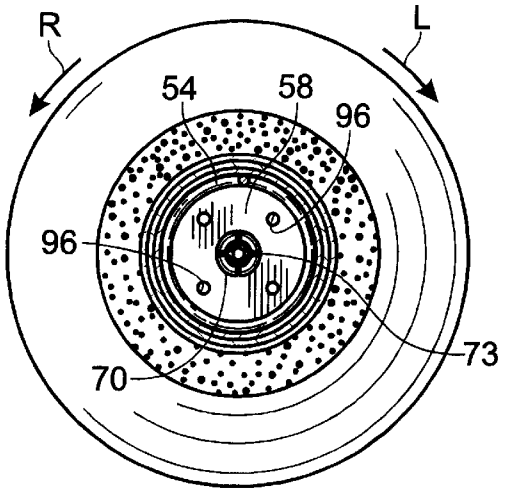
FIG. 6 is a cross-sectional front view of the toy of FIG. 1 in the unlatched, substantially retracted position of FIG. 4, showing the piston with four air holes to decrease the damping effect of the air in the cylinder to speed extension of the tail and showing a circular, slotted latch attached at the end of the tail shaft.

A latching mechanism, indicated generally at 62, is selectively operable by the user to fix tail portion 18*a* in the reduced-length condition (retracted position) and to release the tail portion from the fixed condition or position. Alternatively, latching mechanism 62 may be configured to fix tail portion 18*a* in the full-length condition (extended position). Latching mechanism 62 includes a generally cylindrical, radially slotted latch 70, best seen in FIG. 4 and preferably formed of a resilient plastic, which is also attached at one end to piston 54 by screw 60. Latching mechanism 62 also includes a clasp, such as circular hole 74 in end cap 66. Latch 70 includes a compressible member, such as enlarged, pyramid-shaped, slotted head 72 at an end opposite screw 60. Head 72 is configured to engage clasp 74 because head 72, due to its sloped, pyramid sides and four slots 73 (FIG. 6), can compress and fit through the hole when pushed into the retracted position and be retained there by its flat pyramid base. A switch 76 is disposed within head portion 11 below an outer surface 78 of head portion 11. The switch is operable by the user by depressing the outer surface of head portion 11, as shown by arrow UL in FIG. 4, to shift the switch rearward so that a sloped, internal face 80 of switch 76 compresses latch head 72 so that the base of head 72 slips through clasp 74, thus releasing the clasp's hold on the latch.

Figure 4:
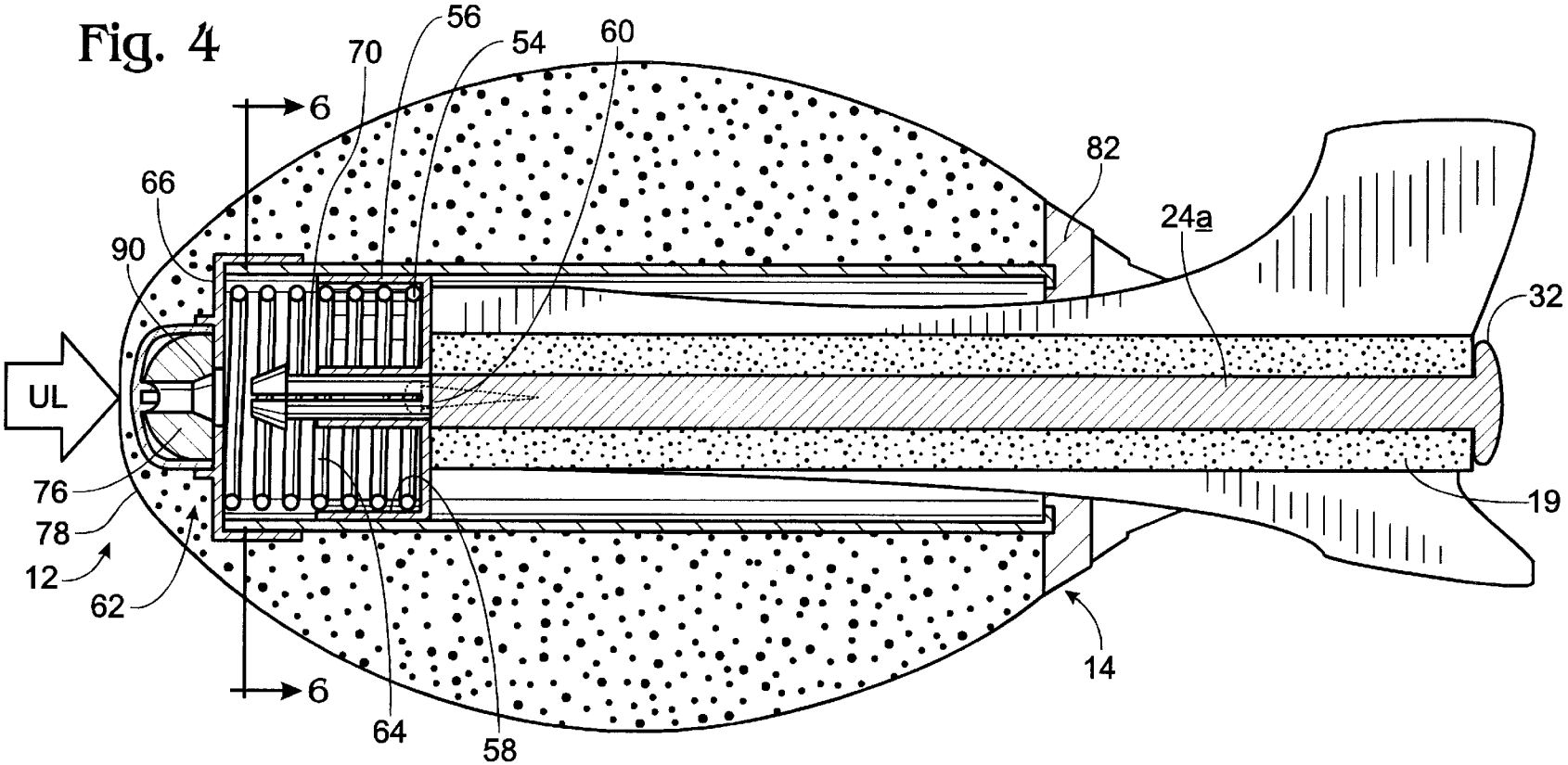
FIG. 4 is a cross-sectional side view of the toy of FIG. 1 with the tail substantially in the retracted position but with the switch depressed and the latching mechanism disengaged so that the spring is moving the piston and the tail toward the extended position.

FIG. 4 shows the toy just after the clasp has released the latch and the tail portion is moving rearward. Four air holes 96 may be provided through basewall 58 of piston 54 to allow fluid, typically air, in the cylinder to flow therethrough to reduce the damping of the piston and allow faster movement of tail portion 18*a* between positions.

Various other methods of position control and engagement which allow the tail portion to move relative to the head portion along the longitudinal axis and to be fixed at one or more positions are also within the scope of the invention.

Toy 10 also includes a bracket 82 at rear end 14 with a central aperture 84 through which tail portion 18*a* extends. In the preferred embodiment, tail fins 20*a–c* fit into guides along the central aperture so that the bracket prevents rotation of tail portion 18*a,* relative to head portion 11, about axis A. Alternatively, bracket 82 could be configured to allow relative rotation of tail portion 18*a* about axis A.

The user can hold head portion 11 in the hand and throw the toy through the air, imparting a spin to head portion 11 causing it to rotate about its longitudinal axis throughout the flight. As shown from the front in FIG. 6, head portion 11 will rotate counterclockwise when thrown from the user's right hand, as indicated by arrow R, and clockwise when thrown from the user's left hand, as indicated by arrow L.

Manufacture and assembly of the present invention, in its preferred embodiment, is inexpensive and easy. As seen in FIG. 3, shaft 24*a* includes, at an aft end, a restraining flange 32 integrally formed with shaft 24*a* as it is molded. Cylindrical member 19 is extruded with an inner hollow sized to fit over shaft 24*a*. Member 19 is installed by pushing it over the shaft head and along the shaft until it is restrained by flange 32 in the final position best shown in FIG. 3.

Coupling 22*a* alternatively may incorporate the rotatable connection described in U.S. patent application Ser. No. 08/926,951, filed on Sep. 10, 1997 for a Throwing Toy with Non-Spinning Tail, for a toy with a tail portion movable translationally and rotationally relative to the head portion.

It will now be clear that an improvement in this art has been provided which accomplishes the objectives set forth above. While a preferred embodiment of the invention and a preferred method of manufacturing it have been disclosed, it is appreciated that variations and modifications with respect thereto may be made without departing from the spirit of the invention.

We claim:

1. A throwing toy having an axis defined therethrough, the toy configured to be held in a user's hand and thrown by the user with the user's hand imparting to the toy during release a spin about the toy's axis, the toy comprising:

a head portion having a front end and a rear end;

a tail portion adjacent the rear end of the head portion, the tail configured to be selectively changeable by the user between an extended position wherein at least a part of the tail extends rearward of the head portion along the axis for a tail length and a retracted position wherein the tail length is reduced; and a switch mounted on the toy, the switch operable by the user selectively to change the tail between the retracted position and the extended position.

2. The throwing toy of claim 1, wherein the switch is mounted to the head portion.

3. The throwing toy of claim 1, wherein the switch is depressible by the user to release the tail from at least one of the retracted and extended positions.

4. The throwing toy of claim 1, wherein the switch is operable by the user to release the tail from the retracted position.

5. The throwing toy of claim 1, further comprising a biasing means for urging the tail toward one of the retracted and extended positions, and wherein the switch is operable by the user to release the tail from the other one of the retracted and extended positions.

6. The throwing toy of claim 5, wherein the biasing means urges the tail toward the extended position and the switch releases the tail from the retracted position.

7. The throwing toy of claim 1, wherein the head portion defines an outer surface, and further wherein the switch is disposed within the head portion below the outer surface.

8. The throwing toy of claim 7, wherein the switch is operable by depressing the outer surface adjacent the switch.

9. A throwing toy configured to be held in a user's hand and thrown by the user, the toy comprising:

a head portion having a front end and a rear end:

a tail portion adjacent the rear end of the head portion, the tail configured to be selectively changeable by the user between an extended position wherein at least a part of the tail extends rearward of the head portion for a tail length and a retracted position wherein the tail length is reduced; and a latching mechanism coupled between the head portion and the tail portion, the latching mechanism selectively operable by the user to fix the tail in one of the positions and operable by a user to unlatch the tail from the fixed position.

10. The throwing toy of claim 9, wherein the latching mechanism includes a switch operable by the user selectively to change the tail between the retracted position and the extended position.

11. The throwing toy of claim 10, wherein the switch is disposed within the head portion below an outer surface of the head portion, the switch operable by the user by depressing the outer surface of the head portion.

12. The throwing toy of claim 9, wherein the latching mechanism fixes the tail in the retracted position, and is operable to unlatch the tail from the retracted position.

13. The throwing toy of claim 1, wherein the switch is disposed within the head portion below an outer surface of the head portion, the switch operable by the user by depressing the outer surface of the head portion adjacent the switch.

14. The throwing toy of claim 1, wherein the tail portion is fixed against rotation, relative to the head portion, about the longitudinal axis.

15. The throwing toy of claim 1 further comprising a bracket coupled to the head portion adjacent the rear end, the bracket having a central aperture defined therethrough, the tail extending through the aperture.

16. The throwing toy of claim 14 wherein the bracket prevents rotation of the tail portion, relative to the head portion, about the longitudinal axis.

* * * * *